United States Patent [19]

Egli

[11] Patent Number: 4,944,631

[45] Date of Patent: Jul. 31, 1990

[54] MACHINE FOR REDEVELOPING THE CONSTRUCTIONAL LAYERS OF ROADS

[75] Inventor: Urs Egli, Wetzikon, Switzerland

[73] Assignee: Egli AG, Wetzikon, Switzerland

[21] Appl. No.: 269,995

[22] Filed: Nov. 10, 1988

[30] Foreign Application Priority Data

Nov. 18, 1987 [CH] Switzerland ..... 04481/87

[51] Int. Cl.[5] ..... E01C 23/08; E01C 23/12

[52] U.S. Cl. ..... 404/91; 404/92; 404/111

[58] Field of Search ..... 404/90, 91, 92, 111

[56] References Cited

U.S. PATENT DOCUMENTS

| | | | |
|---|---|---|---|
| 1,702,690 | 2/1929 | Gregg | 404/111 |
| 4,172,679 | 10/1979 | Wirtgen | 404/90 |
| 4,272,212 | 6/1981 | Bauer, Jr. et al. | 404/91 |
| 4,317,642 | 3/1982 | Wirtgen | 404/91 |
| 4,335,974 | 6/1982 | Wirtgen | 404/91 |
| 4,453,856 | 6/1984 | Chiostri et al. | 404/91 |
| 4,473,320 | 9/1984 | Register | 404/91 |

FOREIGN PATENT DOCUMENTS

| | | | |
|---|---|---|---|
| 1288241 | 2/1987 | Switzerland | 404/91 |

*Primary Examiner*—Jerome W. Massie
*Assistant Examiner*—Gay Ann Spahn
*Attorney, Agent, or Firm*—Herbert Dubno

[57] ABSTRACT

A machine is provided for constructing, in particular, redeveloping, the constructional layers of roads, preferably by re-using the old material removed from the road; wherein a receiving silo for the old material, which is mounted on a chassis of a motor-driven running gear, is feedable, preferably in regulatable quantities, to a horizontal stream crusher; said crusher being in connection, via a dosaging conveying device, with a mixer, also mounted on said chassis, whereto additional material components from at least one additional tank or silo, supported on said chassis, may be fed and wherefrom the prepared material ready for distribution is fed, by way of a conveyor worm, to a screed drawn along behind said chassis. Such a machine permits, in addition to the cold recycling of asphalt, also the construction of cold-mix foundation layers as well as a stabilization and a direct distribution of practically any supporting-layer materials.

4 Claims, 1 Drawing Sheet

Fig. 1
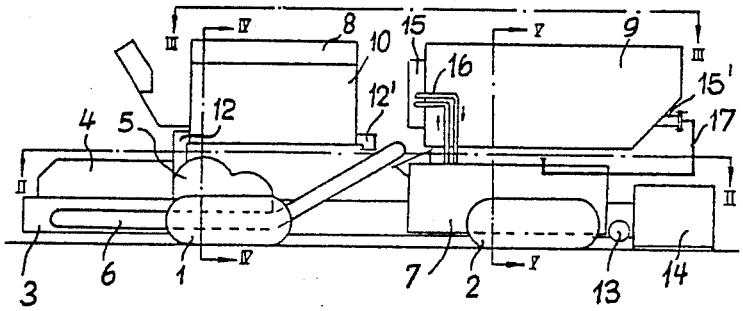
Fig. 2
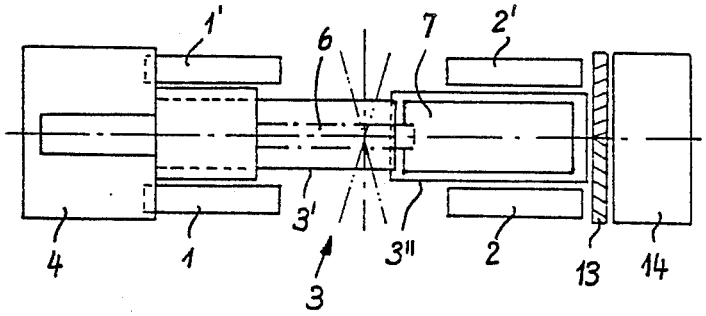
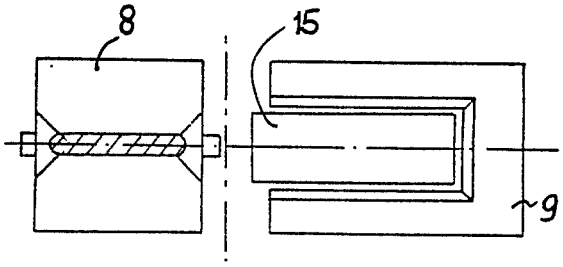
Fig. 3
Fig. 4
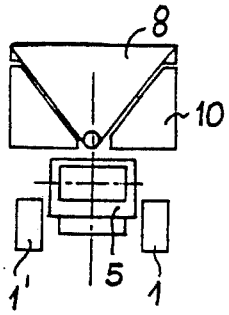
Fig. 5
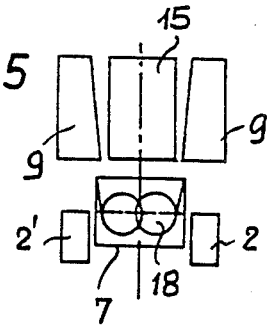

MACHINE FOR REDEVELOPING THE CONSTRUCTIONAL LAYERS OF ROADS

BACKGROUND OF THE INVENTION

The present invention relates to a new and improved machine for constructing, in particular for redeveloping, the constructional layers of roads, preferably by re-using the old material removed from the road.

In the field of road repairing and redevelopment, the so-called cold recycling is the prevalent technology, whereby it is attempted to re-use the bituminous surfacing material removed from a road surface by breaking up or cutting. In this connection, the old material is first fed to a crusher for crushing and homogenization, in order, then, to prepare the old material for distribution with the addition of bituminous emulsion in a mixer, whereupon the material is laid on the road to be redeveloped.

Those machines that are available for this purpose are, however, only inefficiently usable and can only handle old asphalt in the cold-recycling method on the spot.

Hitherto, a preparation of other materials or a stabilization of old gravel or additional old materials could not, however, be thus carried out.

SUMMARY OF THE INVENTION

It is, therefore, a primary object of this invention to provide a machine of the afore-mentioned kind which permits an immediate, efficient and ecologically-beneficial recycling method of road reconstruction irrespective of the composition of the material.

This is achieved according to the invention wherein, a receiving silo for the old material, which is mounted on a chassis of a motor-driven running gear, is feedable, preferably in regulatable quantities, to a horizontal stream crusher; the crusher being in connection, via a dosaging conveying device, with a mixer, also mounted on the chassis, whereto additional material components from at least one additional tank or silo, supported on the chassis, may be fed and wherefrom the prepared material ready for distribution is fed by way of a conveyor worm to a screed drawn along behind the chassis.

Such a machine can hence not only continuously take up, homogenize, prepare and re-insert the old material removed from the road, but also permits in addition to the cold recycling of cut, respectively, broken-up asphalt, the construction of cold-mix foundation layers with bituminous emulsion as well as, among other things, the hydraulic stabilization of various mineral base materials and the direct distribution thereof to supporting and foundation layers.

Thus, it is possible with this device according to the invention not only to renew bituminous surfaces, but also to redevelop roads having insufficient bearing strength by first having the cut-up asphalt intermediately stored and the roadbed, for example, freezable gravel sand, excavated at a specified thickness of layer, for instance, 15 cm. This material then arrives first in the receiving silo of the machine according to the invention, wherefrom, after preparation with bituminous emulsion and/or cement, lime, flue dust and so forth, is inserted directly again as a cold-mix foundation layer. Thereafter, the intermediately-stored asphalt is fed to the machine according to the invention, is prepared thereby and is then laid directly as basis layer or end layer. Furthermore, a surfacing or wear-resistant layer with cold micro-asphalt can then be laid directly by means of the same machine according to the invention.

A road redeveloped in such manner surpasses the quality of roads hitherto redeveloped using prior-art cold-recycling methods and enlarges the range of practical applications considerably. Moreover, redevelopment with the machine according to the invention can be carried out more economically and is considerably more ecologically beneficially.

Accordingly, advantageous embodiments of the machine according to the invention result when the dosaging conveying device comprises a scraper band between the crusher and the mixer; when, further, the chassis is of box-type construction and is divided into additional tanks for fuel, additives and hydraulic oil and when, furthermore, the chassis comprises an additional tank or silo, which is preferably exchangeable, for granular and powdered components, the worm-controlled outlet thereof opening above the conveying device either upstream of the crusher or upstream of the mixer.

A further advantageous embodiment presents itself when the chassis carries an additional tank for receiving bituminous emulsion or water or the like, which at least partially surrounds the main engine unit in order to absorb radiant heat.

Exceptional results are, moreover, achieved when the motor unit comprises a diesel engine, the cooling-water circulation and/or the exhaust flow thereof being conducted for heat exchange through the mixer, the cooling-water circulation serving for the preliminary heating of the additional components.

BRIEF DESCRIPTION OF THE DRAWING

The invention and objects will be better understood and become apparent when consideration is given to the following drawing with accompanying detailed description thereof, wherein:

FIG. 1 is a diagrammatic side view of the machine for redeveloping the constructional layers of roads according to the invention;

FIG. 2 is a schematic top view taken along the line II—II of FIG. 1;

FIG. 3 is a schematic partial top view taken along the line III—III of FIG. 1;

FIG. 4 is a schematic cross-sectional view taken along the line IV—IV of FIG. 1; and FIG. 5 is a schematic cross-sectional view taken along the line V—V of FIG. 1.

DETAILED DESCRIPTION OF THE PREFERRED EMBODIMENTS

Describing now the drawings, the illustrated machine for redeveloping the constructional layers of roads as schematically represented in FIGS. 1 through 5 comprises a chassis 3 made of an articulated frame with the front wagon or limber mount base 3' and the rear wagon or caisson mount base 3'', which are each supported on running gear 1 and 1', respectively 2 and 2' (FIG. 2). For statical reasons, the frames are of box-type design and present, thereby, the possibility of creating tanks for the reception of fuel, hydraulic oil and fluid additives (not shown). The running gear 1,1', 2 and 2' may be customary hydraulic-powered, independent caterpillar-type running gear which allow the relatively long and heavy machine to move along. Vehicles of this kind are as such known and thus detailed description of construction, drive and control are unnecessary here.

Essential to the invention here is that a receiving silo 4 for, chiefly, old material is disposed on the front end of the chassis 3 and wherefrom the old material may be fed to a horizontal stream crusher 5 wherein the old material is broken up and homogenized. Preferably, the construction is such that the material in the silo 4 slides via an inclined plane to the crusher 5, respectively, to a conveying device 6, wherewith a simple dosing rake is sufficient to effect a suitable exclusion of oversize pieces (not shown). For the transport of the old material from the silo into the crusher, vibrating planes and the like are, however, also possible.

The crusher comprises a crusher as well as a calibrating device, which is adapted to take up all larger pieces of material from the lower scraper belt 6 and conduct them into the region of the crusher (not shown).

According to the invention, a mixer 7 is, moreover, inserted after the crusher 5, is mounted on the chassis 3 and is in connection, via a dosaging conveying device, with the mixer 7.

The conveyor device may, in this case, be the aforementioned scraper belt 6, of which the transport velocity as well as the size of the appropriately slide-controlled discharge outlet on the crusher 5 permits a volumetric dosage (not shown).

The mixer 7 is advantageously a cross-compound mixer 18 or twin shaft mixer (FIG. 5) for a greatest possible mixing effect, in particular also for the preparation of stabilization material.

The mixer 7 pushes its mixed material in front of screed 14, disposed at the end of the chassis 3, where the material ready for distribution is taken by conveyor worms 13 and spread evenly over the width of the screed 14. The distribution of mixed materials by means of a screed is as such known and requires no further explanation here.

In addition to the previously-mentioned tanks (not shown) for fuel, hydraulic oil and additives, which may be conveyed in customary manner by pump means, in the chassis 3, it is intended according to the invention to feed additional material components to the mixer 7 from at least one further additional tank or silo mounted on the chassis 3.

A first additional material component in the form of, in particular, a bituminous emulsion or also water is taken from an additional tank 9, which is securely mounted on the chassis 3 and at least partially surrounds the main engine unit 15 of the machine in order to utilize the radiant heat of the motor unit for heating the contents of the additional tank 9.

By way of appropriate dosing means (not shown), the bituminous emulsion or the water may then be fed into the mixer 7.

Without additional processing energy, a further heating of the material prepared ready for distribution and, therewith, an improvement in quality, may be achieved when, as indicated in FIG. 1, in the first place, the exhaust 15' of the engine unit 15 is connected, via a pipe 17, with the inside of the mixer 7 in order to attain there an interchange of heat with the material to be mixed. The exhaust gas may then escape at a suitable place.

Furthermore, the cooling water of the motor, diesel engine 15, may be conducted via an appropriate heat-exchanger system 16 through the mixer 7, or be employed for the preheating of the additional components.

Moreover, an additional tank 8, which is preferably exchangeable, for the powdered or granular components is disposed on the chassis 3, the worm-controlled outlet 12 or 12' thereof opening either upstream of the crusher 5 or at the upper end of the scraper belt 6 upstream of the mixer 7. Such an arrangement permits a precise volumetric dosing of the granular additional components taken from this tank.

Further additional tanks 10 for water or any additive may be provided, as is indicated in FIG. 4.

The control of the machine as well as the operating procedure may, of course, take place manually or automatically, which is not illustrated in more detail, as such operations are known. Advantageously, suitable hydraulic and electric power functions are drawn off the main engine unit 15. For example, the running gear, the crusher, the mixer, the screed, the steering, among other things, may be hydraulically driven, whereas the power for all the dosage devices, the valves, the regulating flaps, amongst other things, as well as the control electronic, is electrically driven.

As can be seen from the aforegoing, the machine for redeveloping the constructional layers of roads according to the invention permits in the first place the incorporation of any minerals in form of cut old asphalt, various qualities of gravel, refuse slag etc., these materials arriving, then, in a preferably continuous process, broken and homogenized and in volumetric, if necessary, weighed dosage at the mixer, under the possible simultaneous addition of one or several dosed fluid components. In addition to this, a powdered component such as cement and/or lime and so forth may be admixed. These individual components produce a homogenous mass ready for distribution, which may be inserted in variable width and thickness. Through the previously-described heat exchange, the surface of the individual granules of material to be mixed may be heated in an advantageous manner, thereby improving the quality.

Thus, all requirements are realized in order to be able to prepare and directly insert with this machine on the spot old asphalt in the cold-recycling process as well as also cold-mix foundation layers with bituminous emulsion as well as hydraulic stabilization layers. In addition thereto, this machine allows fundamentally also the preparation and distribution of new materials.

While there are shown and described present preferred embodiments of the invention, it is to be distinctly understood that the invention is not limited thereto, but may be otherwise variously embodied and practiced within the scope of the following claims.

Accordingly, What I claim is:

1. A machine for constructing a road layer through reuse of old material removed from a road, comprising:

a motor whose heat is transferred by means selected from the group consisting of a cooling-water circulation system and an exhaust flow system;

a chassis for said motor, said chassis being of box-like construction and divided into a plurality of tanks for fuel, additives and hydraulic oil;

a silo for receiving said old material, said silo being mounted on said chassis;

a horizontal stream crusher having a major longitudinal axis through a length thereof, said axis being directed parallel to said road layer, said crusher feedable with said old material in regulatable quantities from said silo, said crusher having associated therewith a means for feeding said old material in regulatable quantities from said silo;

a mixer mounted on said chassis having an opening for receiving said old material at an upper end thereof distant from said road layer and said mixer being subjected to heat exchange by said heat transfer means;

a dosaging conveying device comprising a scraper band positioned between said crusher and said mixer, said scraper band being angled upward above said crusher with an end of said scraper band terminating over said opening of said mixer;

a screed drawn along behind said chassis; and a conveyor worm between said mixer and said screed capable of feeding prepared material ready for distribution therebetween.

2. The machine as defined in claim 1, wherein:

said chassis comprises an additional tank which is exchangeable, to contain granular and powdered components, said additional tank having a worm-controlled outlet opening above said conveying device upstream of said crusher and said mixer to deliver a precise volumetric dosing of additional granular components to said mixer.

3. The machine as defined in claim 1, wherein:

said chassis carries an additional tank for receiving bituminous emulsion which at least partially surrounds said motor in order to absorb radiant heat.

4. The machine as defined in claim 1, wherein:

said cooling-water circulation serves for preliminary heating of additional components.

* * * * *